US007300202B2

(12) United States Patent
Mo

(10) Patent No.: US 7,300,202 B2
(45) Date of Patent: Nov. 27, 2007

(54) CLOCK HAVING A PLAYING FUNCTION

(75) Inventor: Shanker Mo, Taichung Hsien (TW)

(73) Assignee: Centre Clock Industry Co., Ltd., Taichung Hsien (TW)

( * ) Notice: Subject to any disclaimer, the term of this patent is extended or adjusted under 35 U.S.C. 154(b) by 329 days.

(21) Appl. No.: 11/080,245

(22) Filed: Mar. 15, 2005

(65) Prior Publication Data

US 2006/0209636 A1 Sep. 21, 2006

(51) Int. Cl.
*G04B 37/00* (2006.01)
*G04B 47/04* (2006.01)

(52) U.S. Cl. ..... 368/309; 368/223; 368/285

(58) Field of Classification Search ..... 368/1, 368/3, 10, 45, 232, 276, 285, 309, 327
See application file for complete search history.

(56) References Cited

U.S. PATENT DOCUMENTS 611,086 A * 9/1898 Tickner et al. ..... 273/115
2,651,851 A * 9/1953 Valpey ..... 434/208
4,128,949 A * 12/1978 Marason et al. ..... 434/304
4,542,904 A * 9/1985 Parlato ..... 273/116
4,711,586 A * 12/1987 Kizawa ..... 368/232
5,751,667 A * 5/1998 Nunes ..... 368/223
6,026,061 A * 2/2000 Heck ..... 368/45

* cited by examiner

*Primary Examiner*—P. Austin Bradley
*Assistant Examiner*—Jeanne-Marguerite Goodwin
(74) *Attorney, Agent, or Firm*—Alan Kamrath; Kamrath & Associates P.A.

(57) ABSTRACT

A clock includes a main body having a lower space and provided with a protruding post extended into the lower space, a face plate mounted on the main body and formed with a plurality of holes, a tumbler mounted in the lower space of the main body and rested on the protruding post, a top cover mounted on the main body to form an upper space, and a plurality of rolling balls mounted in the upper space and placed on the face plate. Thus, the clock has a playing function and can produce a figure arrangement variation.

18 Claims, 6 Drawing Sheets

CLOCK HAVING A PLAYING FUNCTION

BACKGROUND OF THE INVENTION

1. Field of the Invention

The present invention relates to a clock, and more particularly to a clock having a playing function.

2. Description of the Related Art

A conventional clock comprises a main body, a face plate mounted on the main body, a time scale printed on the face plate, and a tumbler mounted on the main body and having a shaft extended through the face plate and provided with three pointers. However, the conventional clock only has a single function, thereby limiting the versatility of the conventional clock.

SUMMARY OF THE INVENTION

In accordance with the present invention, there is provided a clock, comprising a main body having a lower space and provided with a protruding post extended into the lower space; a face plate mounted on the main body and formed with a plurality of holes; a tumbler mounted in the lower space of the main body and rested on the protruding post; a top cover mounted on the main body to form an upper space; and a plurality of rolling balls mounted in the upper space and placed on the face plate.

The primary objective of the present invention is to provide a clock having a playing function and having a figure arrangement variation.

Another objective of the present invention is to provide a clock, wherein the users can shake the main body successively until all of the rolling balls are locked in the respective hole of the face plate, thereby achieving a playing effect.

A further objective of the present invention is to provide a clock, wherein the holes of the face plate are arranged to form a pattern, character, figure, or trademark, thereby enhancing the aesthetic quality of the clock.

A further objective of the present invention is to provide a clock, wherein each of the rolling balls is locked in the respective hole of the face plate to indicate a pattern, character, figure, or trademark.

A further objective of the present invention is to provide a clock, wherein all of the rolling balls having different diameter are locked in the respective holes of the face plate having different diameter so as to indicate a complete time scale.

Further benefits and advantages of the present invention will become apparent after a careful reading of the detailed description with appropriate reference to the accompanying drawings.

DETAILED DESCRIPTION OF THE INVENTION

Figure 1:
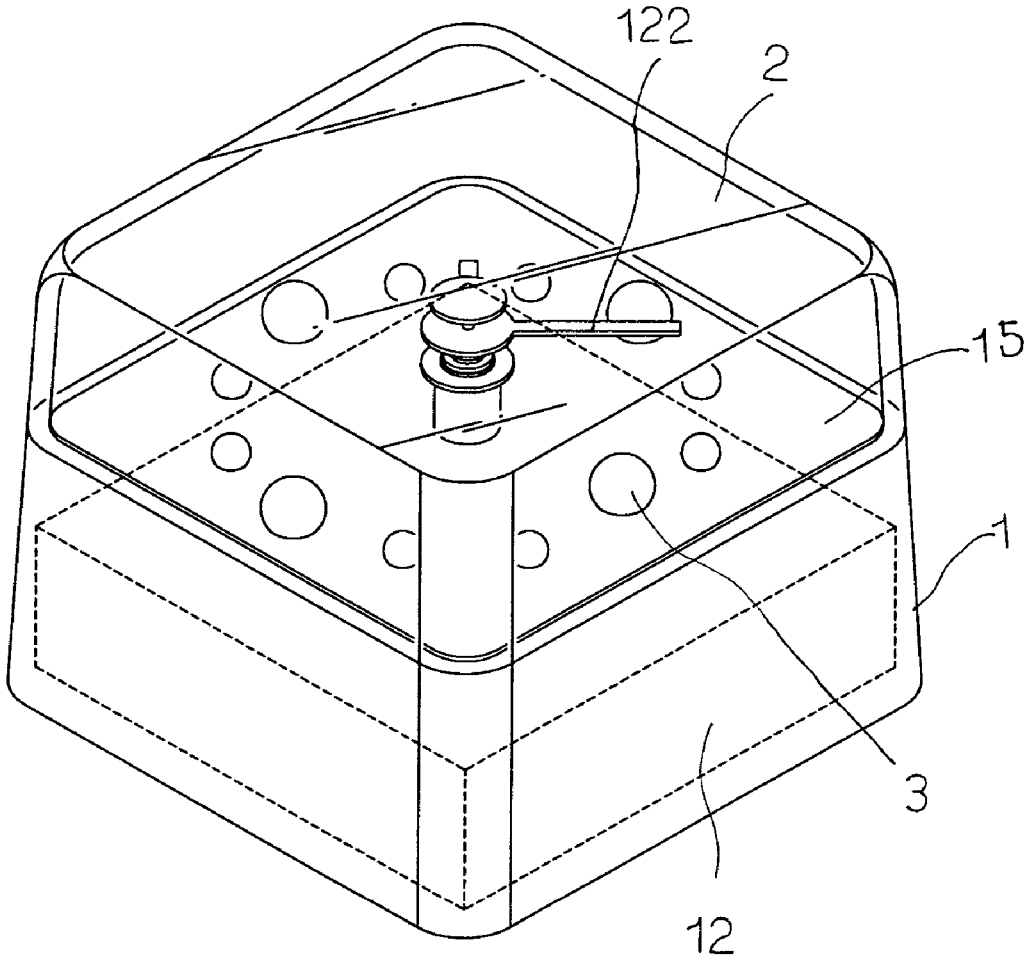
FIG. 1 is a perspective view of a clock in accordance with the preferred embodiment of the present invention.
Figure 2:
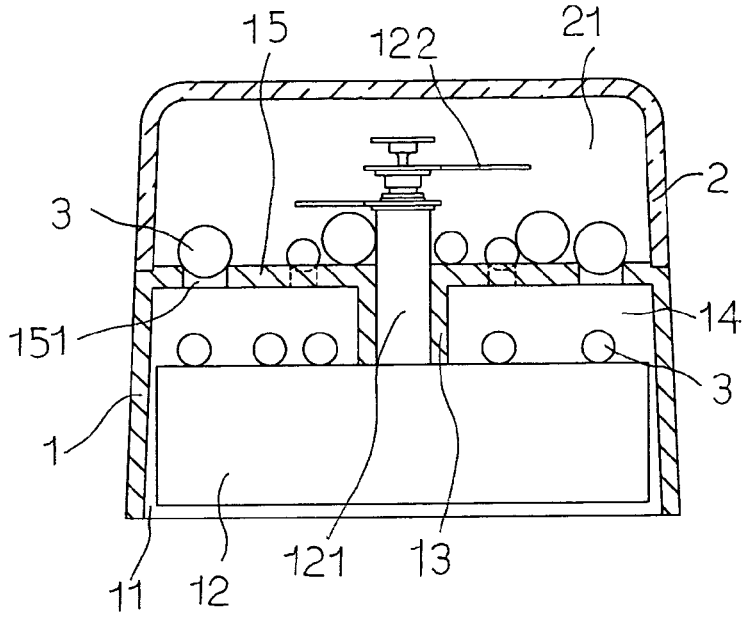
FIG. 2 is a plan cross-sectional view of the clock as shown in FIG. 1.
Figure 3:
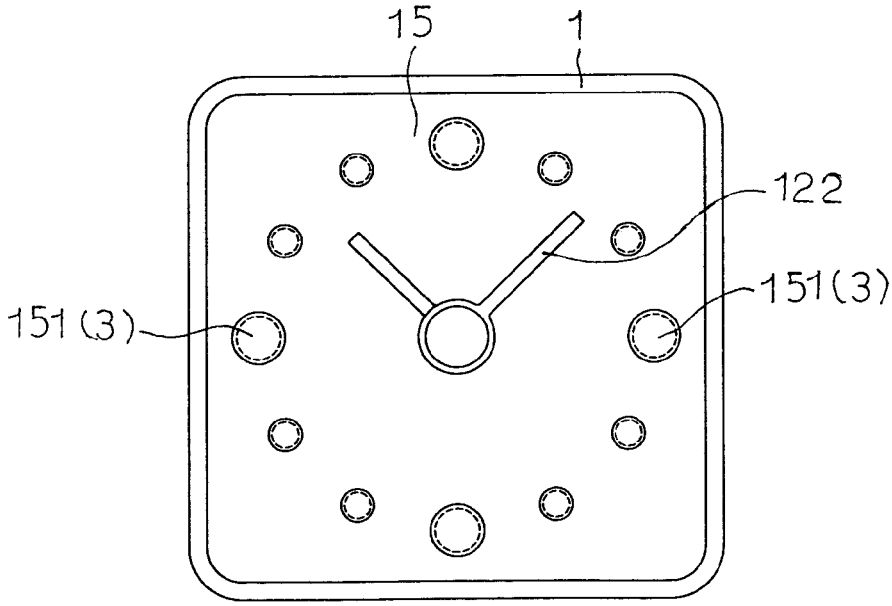
FIG. 3 is a plan view of the clock as shown in FIG. 1.

Referring to the drawings and initially to FIGS. 1-3, a clock in accordance with the preferred embodiment of the present invention comprises a main body 1 having a lower space 11 and provided with a protruding post 13 extended into the lower space 11, a face plate 15 mounted on the main body 1 and formed with a plurality of holes 151, a tumbler 12 mounted in the lower space 11 of the main body 1 and rested on the protruding post 13, a top cover 2 mounted on the main body 1 to form an upper space 21, and a plurality of rolling balls 3 mounted in the upper space 21 and placed on the face plate 15.

The main body 1 has a receiving space 14 defined between the face plate 15 and the tumbler 12. The tumbler 12 is limited by the protruding post 13 and has a shaft 121 extended through the protruding post 13 and extended from the lower space 11 into the upper space 21. The shaft 121 of the tumbler 12 is provided with three pointers 122. The face plate 15 is located between the upper space 21 and the lower space 11. Each of the holes 151 of the face plate 15 is a through hole and has a circular shape, and the holes 151 of the face plate 15 have different diameter. Each of the holes 151 of the face plate 15 is connected to the upper space 21 and the receiving space 14. The upper space 21 is defined between the top cover 2 and the face plate 15. Each of the rolling balls 3 has a circular shape, and the rolling balls 3 have different diameter. The rolling balls 3 are made of different material and have different colors.

Figure 4:
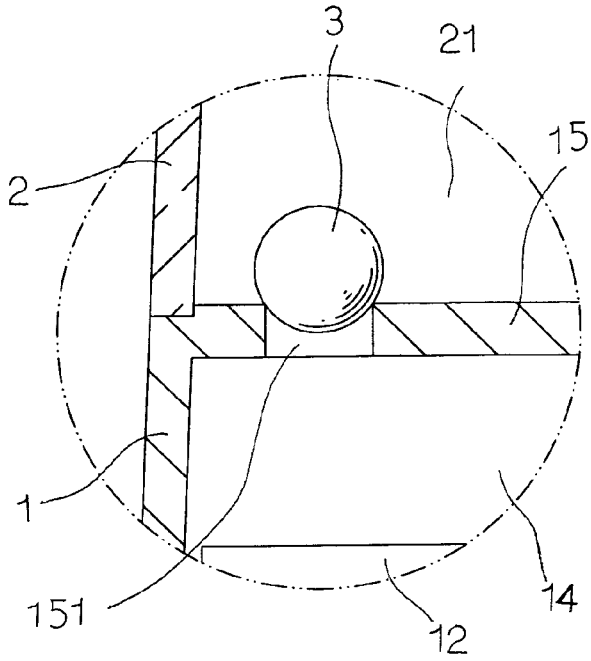
FIG. 4 is a locally enlarged view of the clock as shown in FIG. 2.
Figure 5:
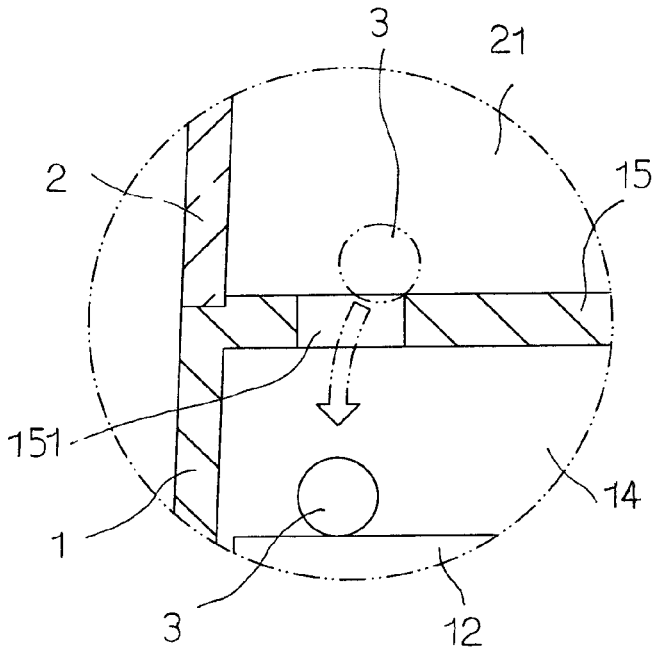
FIG. 5 is an operational view of the clock as shown in FIG. 4.

Referring to FIGS. 1-5, the holes 151 of the face plate 15 are arranged to form a time scale as shown in FIG. 3, and the rolling balls 3 are placed on the face plate 15 as shown in FIG. 2. In addition, the holes 151 of the face plate 15 have different diameter, and the rolling balls 3 have different diameter. When users wish to play the game, the rolling balls 3 are rolling in the upper space 21 when shaking the main body 1. When the diameter of the rolling ball 3 is greater than that of the respective hole 151 of the face plate 15, the rolling ball 3 is locked in the respective hole 151 of the face plate 15 as shown in FIG. 4. When the diameter of the rolling ball 3 is smaller than that of the respective hole 151 of the face plate 15, the rolling ball 3 is extended through the respective hole 151 of the face plate 15 and dropped into the receiving space 14 as shown in FIG. 5, which indicates the game fails. When all of the rolling balls 3 are locked in the respective hole 151 of the face plate 15 as shown in FIG. 1, the game is finished and the user wins the game.

Thus, the users can shake the main body 1 successively until all of the rolling balls 3 are locked in the respective hole 151 of the face plate 15, thereby achieving a playing effect.

Figure 6:
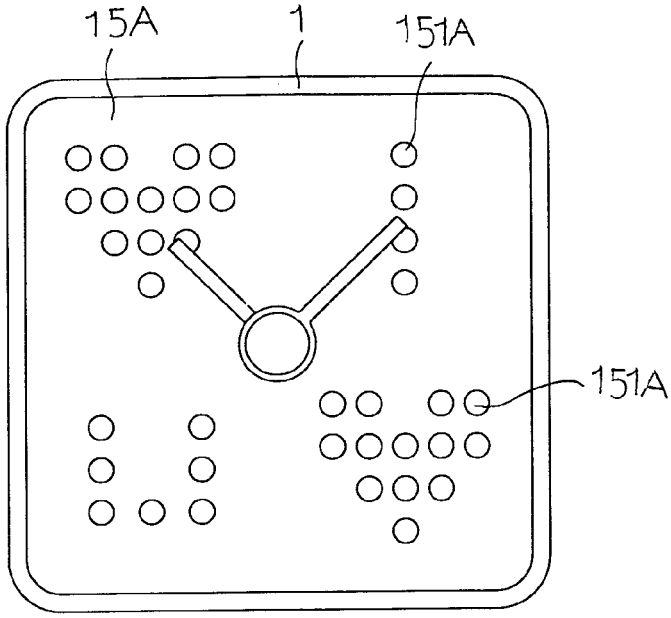
FIG. 6 is a plan view of a clock in accordance with another preferred embodiment of the present invention.

Referring to FIG. 6, the holes 151 of the face plate 15 are arranged to form a pattern, character, figure, or trademark, thereby enhancing the aesthetic quality of the clock. In addition, each of the holes 151 of the face plate 15 has the same diameter.

Figure 7:
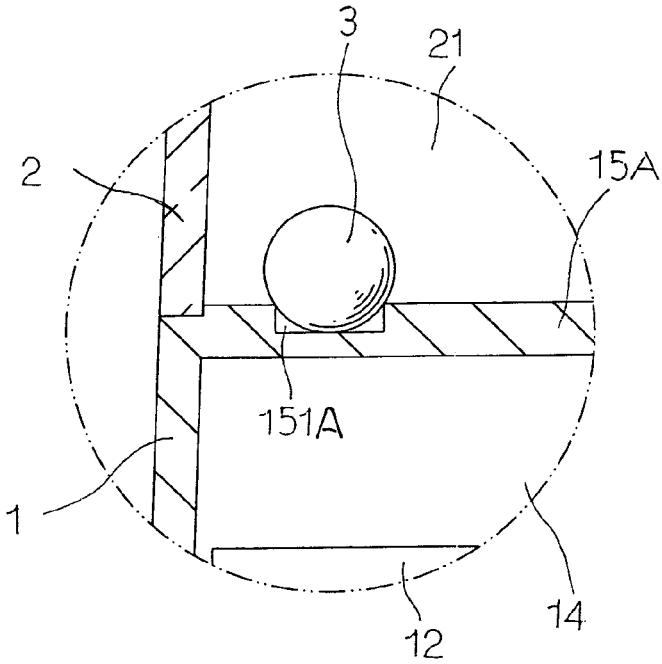
FIG. 7 is a plan cross-sectional view of the clock as shown in FIG. 6.

Referring to FIG. 7, each of the holes 151A of the face plate 15A is a blind hole and has a diameter smaller than that of each of the rolling balls 3, so that each of the rolling balls 3 is locked in the respective hole 151A of the face plate 15A to indicate a pattern, character, figure, or trademark.

Figure 8:
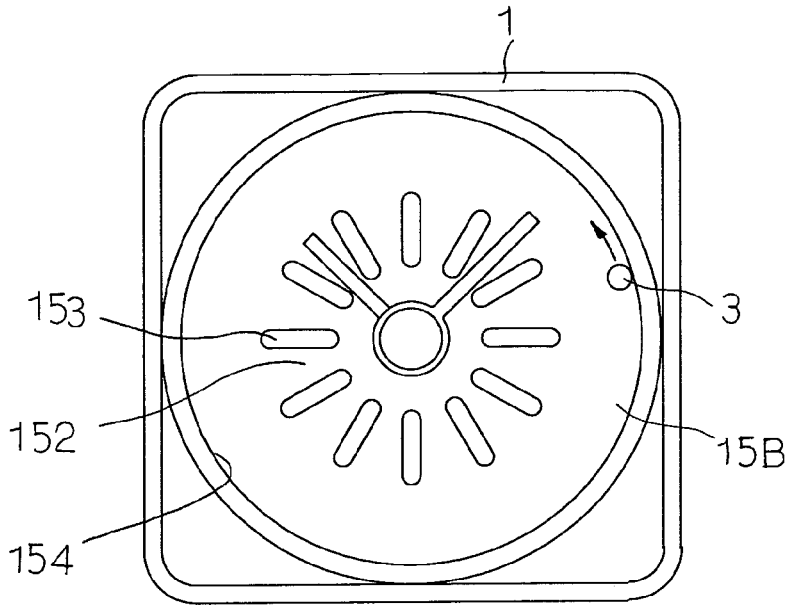
FIG. 8 is a plan view of a clock in accordance with another preferred embodiment of the present invention.
Figure 9:
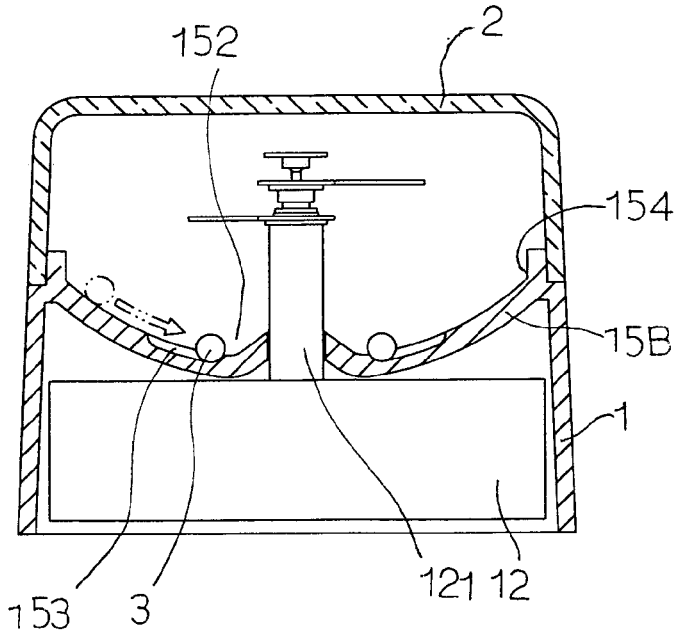
FIG. 9 is a plan cross-sectional view of the clock as shown in FIG. 9.

Referring to FIGS. 8 and 9, the face plate 15B is substantially arc-shaped and has a concave chamber 152 having an upper portion formed with a guide track 154 to guide movement of the rolling balls 3 and a lower portion formed with a plurality of elongated positioning slots 153 for positioning the rolling balls 3. Thus, the users can shake the main body 1 to drive the rolling balls 3 to roll along the guide track 154. When all of the rolling balls 3 stops moving, each of the rolling balls 3 is positioned in a respective one of the positioning slots 153. Each of the positioning slots 153 is marked with a different score to enhance the playing effect of the game.

Figure 10:
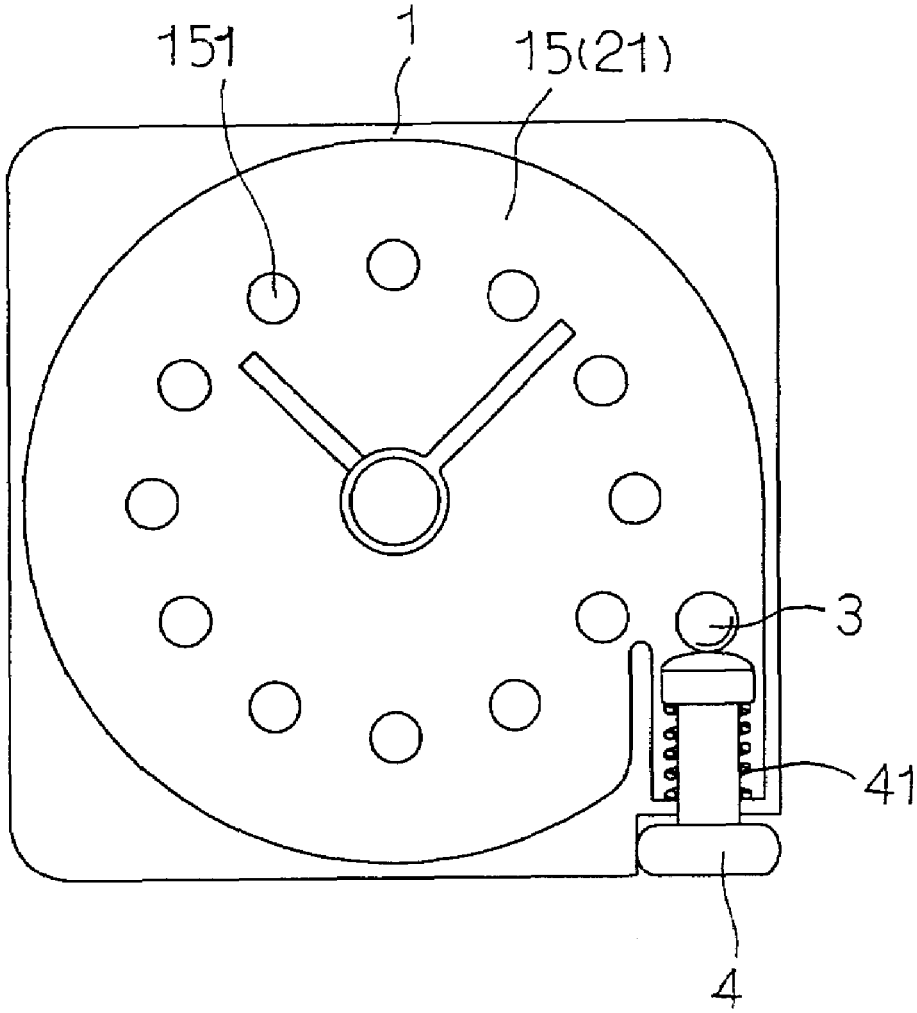
FIG. 10 is a plan view of a clock in accordance with another preferred embodiment of the present invention.

Referring to FIG. 10, the clock further comprises a push lever 4 movably mounted on the main body 1 to push each of the rolling balls 3, and a spring 41 mounted on the push lever 4 and biased between the push lever 4 and the main body 1. Thus, each of the rolling balls 3 is pushed by the push lever 4 to roll in the upper space 21 so that each of the rolling balls 3 is locked in the respective hole 151 of the face plate 15, thereby achieving a playing effect.

Accordingly, the users can shake the main body 1 successively until all of the rolling balls 3 are locked in the respective hole 151 of the face plate 15, thereby achieving a playing effect. In addition, the holes 151 of the face plate 15 are arranged to form a pattern, character, figure, or trademark, thereby enhancing the aesthetic quality of the clock. Further, each of the rolling balls 3 is locked in the respective hole 151A of the face plate 15A to indicate a pattern, character, figure, or trademark. Further, all of the rolling balls 3 having different diameter are locked in the respective holes 151 of the face plate 15A having different diameter so as to indicate a complete time scale.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A clock, comprising:

a main body having a lower space and provided with a protruding post extended into the lower space;

a face plate mounted on the main body and formed with a plurality of holes;

a tumbler mounted in the lower space of the main body and rested on the protruding post;

a top cover mounted on the main body to form an upper space;

a plurality of rolling balls mounted in the upper space and placed on the face plate;

wherein the main body has a receiving space defined between the face plate and the tumbler;

wherein when the diameter of one of the rolling balls is greater than that of the respective hole of the face plate, the rolling ball is locked in the respective hole of the face plate, and when the diameter of one of the rolling balls is smaller than that of the respective hole of the face plate, the rolling ball is extended through the respective hole of the face plate and dropped into the receiving space.

2. The clock in accordance with claim 1, wherein each of the holes of the face plate is connected to the upper space and the receiving space.

3. The clock in accordance with claim 1, wherein the tumbler is limited by the protruding post.

4. The clock in accordance with claim 1, wherein the tumbler has a shaft extended through the protruding post and extended from the lower space into the upper space.

5. The clock in accordance with claim 1, wherein the face plate is located between the upper space and the lower space.

6. The clock in accordance with claim 1, wherein each of the holes of the face plate is a through hole.

7. The clock in accordance with claim 1, wherein each of the holes of the face plate has a circular shape, and the holes of the face plate have different diameter.

8. The clock in accordance with claim 1, wherein each of the rolling balls has a circular shape, and the rolling balls have different diameter.

9. The clock in accordance with claim 1, wherein the upper space is defined between the top cover and the face plate.

10. The clock in accordance with claim 1, wherein the rolling balls are made of different material.

11. The clock in accordance with claim 1, wherein the rolling balls have different colors.

12. The clock in accordance with claim 1, wherein the holes of the face plate are arranged to form a time scale.

13. The clock in accordance with claim 1, wherein the holes of the face plate are arranged to form a pattern, character, figure, or trademark.

14. The clock in accordance with claim 1, wherein each of the holes of the face plate has the same diameter.

15. The clock in accordance with claim 1, wherein each of the holes of the face plate is a blind hole.

16. The clock in accordance with claim 1, wherein each of the holes of the face plate has a diameter smaller than that of each of the rolling balls, so that each of the rolling balls is locked in the respective hole of the face plate to indicate a pattern, character, figure, or trademark.

17. The clock in accordance with claim 1, wherein the face plate is substantially arc-shaped and has a concave chamber having an upper portion formed with a guide track to guide movement of the rolling balls and a lower portion formed with a plurality of elongated positioning slots for positioning the rolling balls.

18. The clock in accordance with claim 1, further comprises a push lever movably mounted on the main body to push each of the rolling balls, and a spring mounted on the push lever and biased between the push lever and the main body.

* * * * *